US005402136A

United States Patent [19]

Goto et al.

[11] Patent Number: 5,402,136

[45] Date of Patent: Mar. 28, 1995

[54] COMBINED CAPACITIVE LOADED MONOPOLE AND NOTCH ARRAY WITH SLITS FOR MULTIPLE RESONANCE AND IMPEDANCE MATCHING PINS

[75] Inventors: Naohisa Goto, A-514, Miyamaedaira-Palm-House, 6-15-1, Tsuchihashi, Miyamae-ku, Kawasaki-shi; Hiroyuki Arai, 301 Academy-Heights, 4-10-10, Koishikawa, Bunkyo-Ku, Tokyo; Kiyoshi Seshimo, Yokohama; Mitsuo Mori, Yokohama; Motoaki Uchida, Yokohama, all of Japan

[73] Assignees: Naohisa Goto, Kawasaki; Hiroyuki Arai, Tokyo; NHK Spring Co., Ltd., Yokohama, all of Japan

[21] Appl. No.: 955,931

[22] Filed: Oct. 2, 1992

[30] Foreign Application Priority Data

Oct. 4, 1991 [JP] Japan ..... 3-258128
Sep. 30, 1992 [JP] Japan ..... 4-262374

[51] Int. Cl.[6] ..... H01Q 1/38; H01Q 9/36; H01Q 13/10; H01Q 21/00

[52] U.S. Cl. ..... 343/729; 343/700 MS; 343/752; 343/770

[58] Field of Search ..... 343/700 MS, 729, 752, 343/767, 770, 828–830, 713; H01Q 1/380, 9/360, 9/380, 9/400, 13/100, 21/240, 21/280, 21/300, 21/000

[56] References Cited

U.S. PATENT DOCUMENTS 3,665,480 5/1972 Fassett ..... 343/700 MS
4,242,685 12/1980 Sanford ..... 343/700 MS

FOREIGN PATENT DOCUMENTS 2152757 8/1985 United Kingdom ..... 343/700 MS

OTHER PUBLICATIONS

"A Flat Diversity Antenna by Disk Loaded Monopole and Notch Array" by H. Arai et al; IEEE Antennas & Propagation Society International Symposium; 1992 Digest, vol. 2, pp. 1085–1089.

"A Flat Diversity Antenna at 900 MHz for Mobile Telephone" by H. Arai et al, Vehicular Technology Society 24nd VTS, vol. 1, pp. 29–32, May 10–13, 1992.

"Flat Energy Density Antenna" by H. Arai et al; Antennas and Propagation Society Symposium, 1991 Digest, vol. 2, pp. 940 to 943.

"Flat Energy Density Antenna" by H. Arai et al, 1990

(List continued on next page.)

*Primary Examiner*—Michael C. Wimer

*Attorney, Agent, or Firm*—Frishauf, Holtz, Goodman & Woodward

[57] ABSTRACT

A conductive layer is formed on one surface of an insulating substrate. Notches are formed in the conductive layer to be axially symmetric at equal angular intervals of 120°. A feeding line of a notch antenna is formed on the other surface of the substrate. The feeding line has a C-shape and wide portions for adjusting the phases of excitation of the notches, and receives power at its one point. A ground plate is arranged to be parallel to the substrate. A feeding rod is connected to the conductive layer. The conductive layer and the ground plate are short-circuited by impedance matching pins. The matching pins are integrally formed with the ground plate. The notches and the feeding line constitute an notch antenna, and the feeding rod, the ground plate, the conductive layer, and the matching pins constitute a capacity loaded monopole antenna. To resonate these antennae at a plurality of resonant points, slits are formed in the conductive layer to be axially symmetric at equal angular intervals of 120°, and branch lines are connected to feeding lines. The slits resonate the capacity loaded monopole antenna at a plurality of frequencies. The branch lines resonate the notches at a plurality of frequencies. When the number of branch lines, the number of slits, and the like are adjusted, a diversity antenna covering a plurality of bands can be obtained.

4 Claims, 16 Drawing Sheets

OTHER PUBLICATIONS

International Symposiium Digest Antenna and Propagation, vol. II, pp. 823–826.

"Vehicular Diversity Flat Antenna at 900 MHz", by H. Arai et al, IEICE Transactions, vol. E74, No. 10, Oct. 1991, pp. 3222–3226.

"A Flat Energy Density Antenna System for Mobile Telephone" by H. Arai et al, IEEE Transactions, Vehicular Technology vol. 40, No. 2, May 1991, pp. 483–486.

1992 International Symposium on Antennas and Propagation, by S. Hosono et al.

"Feed Circuit of Planar Diversity Antenna" by H. Arai et al, 1989 Autumn National Conference of the Institute of Electronics, 1989, vol. 2, p. 54.

"Matching Method and Band Width of Plate Type Antenna", by H. Arai et al, 1990 Spring National Conference of Institute of Electronics, 1990, vol. 2, p. 25.

"Indoor Field Measurements of Planar Energy-density Antenna System" by H. Iwashita et al, 1990 Spring National Conference of Institute of Electronics, 1990, vol. 2, pp. 569–570.

"Multi Function Feed Circuit for Diversity Antenna" by H. Iwashita et al, 1990 Autumn National Conference of Institute of Electronics, 1990, vol. 2, p. 44.

"Propagation Measurement of Flat Energy Density Antenna" by H. Iwashita et al, 1991 Spring National Conference of the Institute of Electronics, 1991, vol. 2, p. 37.

"Feed Circuit and Radiation of Flat Energy Diversity Antenna" by H. Arai et al, 1991 Spring National Conference of Institute of Electronics, 1991, vol. 2, p. 97.

"Flat Two Branches Diversity Antenna" by S. Hosono et al, 1992 Spring National Conference of the Institute of Electronics, 1992, vol. 2, p. 91.

"The Diversity Gain Depending on Feed Circuits of Notch Antenna Array" by S. Hosono, 1992 Autumn National Conference of Institute of Electronics.

"A Planar Ring Patch and Notch Antenna System for Energy-Density Reception of Mobile Telephony" by H. Arai et al, Journal of Institute of Electronics, May 18, 1989, pp. 29–32.

"Radiation Pattern and Feed Circuit of Planar Diversity Antenna" by H. Iwashita et al, Journal of Institute of Electronics, Oct. 27, 1989, pp. 23–28.

"Experimental Remarks of Flat Antenna Configuration, Bandwidth Electrical Volume and Gain" by K. Endo et al, Journal of Institute of Electronics, 1990, pp. 9–14.

"Multi Function Flat Diversity Antenna" by H. Arai et al, Journal of Institute of Electronics, 1990, pp. 21–24.

"Propagation Measurement at Yokohama by Flat Energy-density Antenna" by H. Arai et al, Journal of the Institute of Electronics, 1991, pp. 65–72.

"An Electrically Small, Flat Diversity Antenna" by S. Hosono, Journal of the Institute of Electronics, Nov. 21, 1991, pp. 37 to 42.

COMBINED CAPACITIVE LOADED MONOPOLE AND NOTCH ARRAY WITH SLITS FOR MULTIPLE RESONANCE AND IMPEDANCE MATCHING PINS

BACKGROUND OF THE INVENTION

1. Field of the Invention

The present invention relates to a diversity antenna and, more particularly, to a flat type diversity antenna suitable for movable communication.

The present invention also relates to a flat type diversity antenna capable of covering a plurality of frequency bands.

2. Description of the Related Art

A mobile communication system, e.g., a mobile telephone, employs various types of diversity schemes, e.g., space diversity, power density receiving, and polarization diversity schemes, in order to prevent the influence of fading caused by complex topography and obstacles.

According to the conventional space diversity scheme, antennas having the same polarization are arranged at positions spatially phase-shifted from each other by 90°, and a signal from an antenna in a good condition is selectively used. Since two antennas are arranged at positions phase-shifted from each other by 90°, the installation space is increased.

According to the power density receiving scheme and the polarization diversity scheme, a slot antenna and a monopole antenna are combined. Since two antennas are arranged at spatially the same position, the entire antenna size is increased.

Hence, a conventional diversity scheme antenna is not suitable for mobile communication that needs a small antenna.

As the use of mobile and portable telephones has been spreading remarkably, a single frequency band is becoming insufficient to hold a necessary number of circuits. Hence, a telephone service using a plurality of frequency bands has been studied in the mobile telephone system and the like.

However it is inconvenient and requires the installation space to provide antennas to movable bodies in units of frequency bands. Also, it is difficult to completely cover the plurality of frequency bands by a conventional single antenna.

SUMMARY OF THE INVENTION

The present invention has been made in view of the above situation, and has as its object to provide a small antenna for movable communication which is less influenced by fading.

It is another object of the present invention to provide a small diversity antenna.

It is still another object of the present invention to provide an antenna that can be shared between a plurality of frequency bands and can cover the bandwidths of the plurality of frequency bands.

It is still another object of the present invention to widen the band of an antenna.

In order to achieve the above objects, according to the first aspect of the present invention, there is provided an antenna comprising: an insulating substrate; a conductive layer formed on one surface of the insulating substrate and having notches formed therein to be axially symmetric at substantially equal angular intervals of 120°; and a feeding line, formed on the other surface of the insulating substrate, for exciting the notches at phases shifted from each other by 120°.

According to the second aspect of the present invention, there is provided an antenna comprising: an insulating substrate; a conductive layer formed on one surface of the insulating substrate and having a plurality of notches formed therein; and a feeding line, formed on the other surface of the insulating substrate to overlap the notches, having one end for receiving power, and having wide portions for adjusting phases of excitation of the notches.

According the third aspect of the present invention, there is provided a diversity antenna in which a conductive base plate and a dielectric substrate are arranged substantially parallel to each other, a conductive layer having notches formed therein is formed on one surface of the dielectric substrate, and feeding lines for feeding power to the notches are formed on the other surface of the dielectric substrate. The conductive layer has slits for causing multi-resonance of the capacity loaded monopole antenna. The feeding lines have branch lines for causing multi-resonance of the notches. The slits have either a U shape, an arcuated shape, or a linear shape. The number of bands to be used and a band width to be used can be adjusted by adjusting the number, width, and length of the branch lines and the number, position, and size of the slits. The slits and the notches do not contact each other. The feeding lines do not overlap the slits. The feeding lines are formed to be axially symmetric at almost equal angular intervals. Power is supplied from a feeding coaxial cable to the feeding lines through one point.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Antennas according to the preferred embodiments of the present invention will be described with reference to the accompanying drawings.

First Embodiment

An antenna according to the first embodiment performs power density receiving by combining a flat type capacity loaded monopole antenna having matching pins and a notch antenna.

Figure 1A:
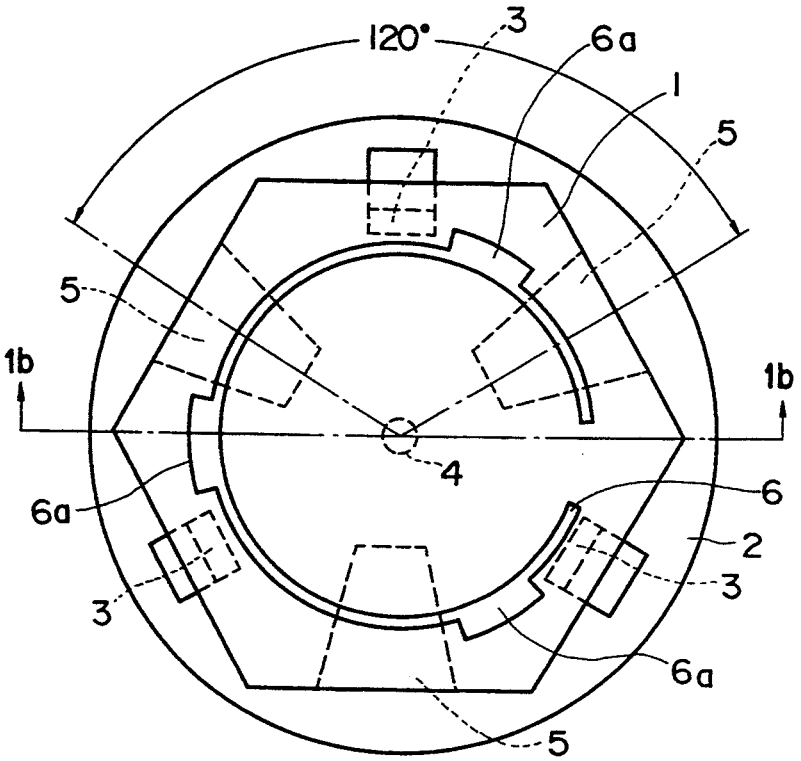
FIGS. 1(*a*) and 1(*b*) are plan and sectional views respectively showing an antenna according to the first embodiment of the present invention.
Figure 1B:
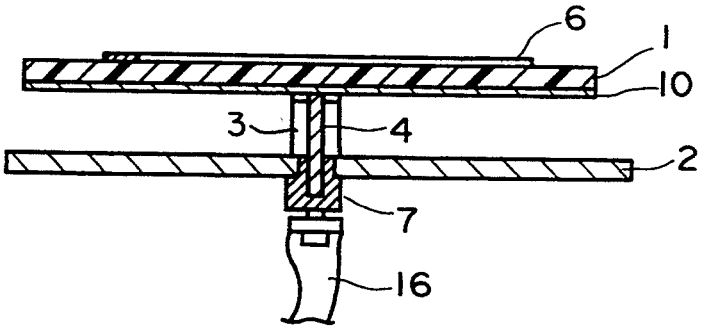
Figure 2:
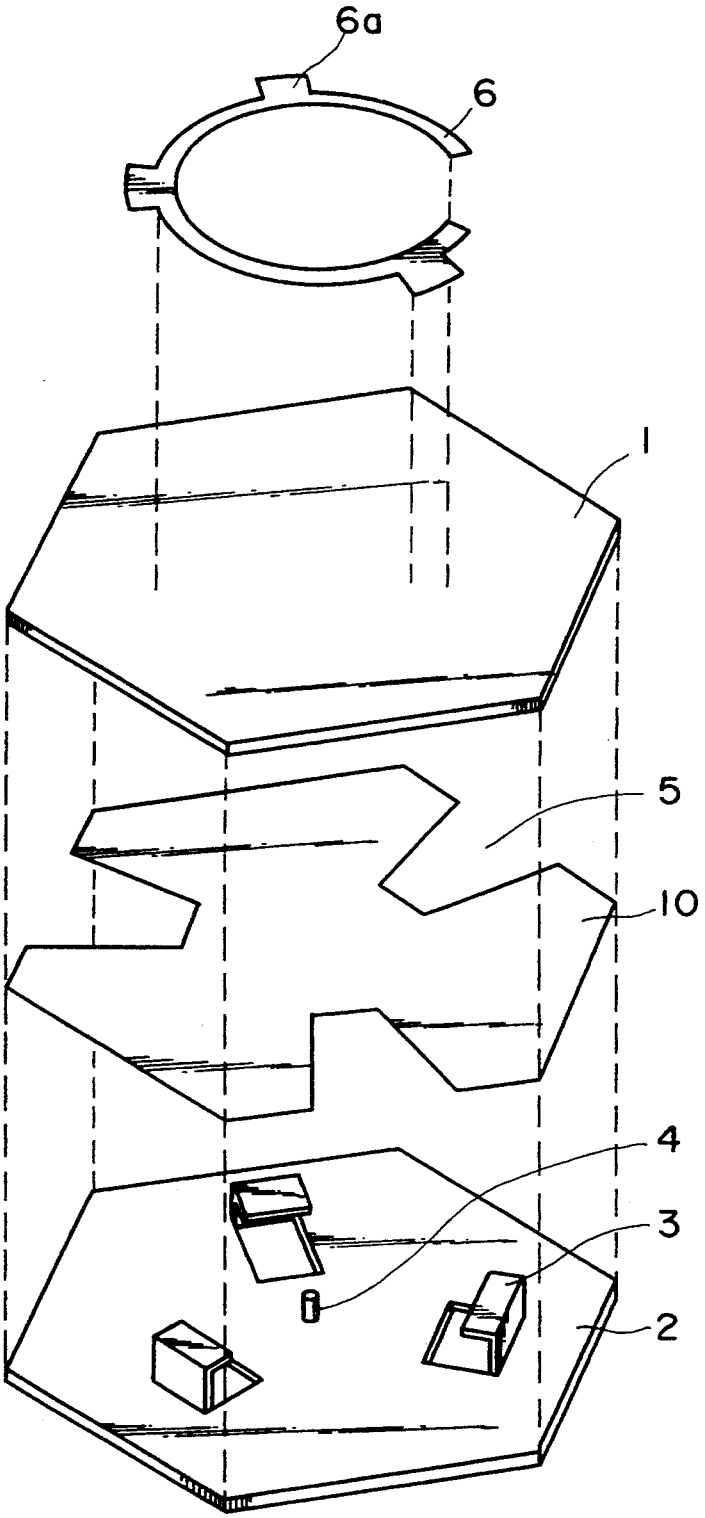
FIG. 2 is an exploded perspective view of the antenna shown in FIG. 1.
Figure 3:
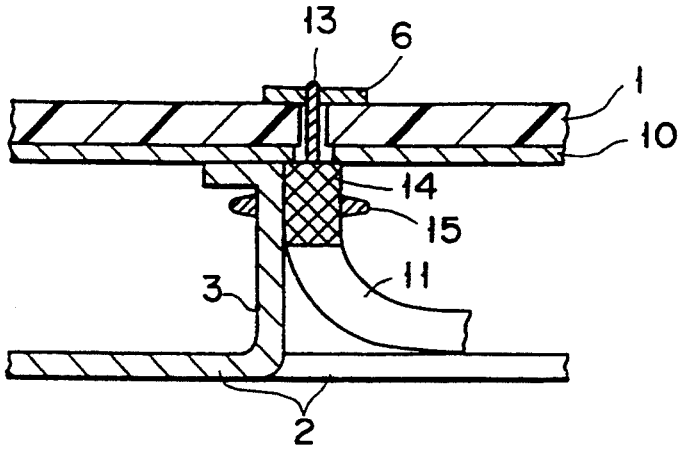
FIG. 3 is a sectional view showing the arrangement of the feeding portion of the antenna shown in FIG. 1.

FIG. 1(*a*) is a plan view of the antenna according to this embodiment, and FIG. 1(*b*) is a sectional view taken along the line 1*b*—1*b* of FIG. 1(*a*). FIG. 2 is an exploded perspective view of the antenna shown in FIGS. 1(*a*) and 1(*b*). FIG. 3 is an enlarged view of the vicinity of an input-impedance matching pin of this embodiment.

The antenna of the first embodiment shown in FIGS. 1(*a*)–3, comprises a dielectric substrate 1 and a metal ground plate (base plate) 2 disposed to be substantially parallel to the dielectric substrate 1 at a predetermined gap. The dielectric substrate 1 has a shape (hexagonal in this embodiment) corresponding to the reception or transmission frequency.

A metal film 10 made of copper, aluminum, or the like is fixed on the lower surface of the dielectric substrate 1. Fan-shaped notches 5 are formed at the pheripheral portions of the metal film 10 to be axially symmetric at equal angular intervals of 120°. The upper end of a feeding rod 4 is connected to substantially the central portion of the metal film 10. An annular (C-shaped) microstrip line (feeding line) 6 for feeding power to the notches 5 is fixed on the upper surface of the dielectric substrate 1.

The three notches 5 are formed to be axially symmetric at equal angular intervals of 120° to obtain the non-directional isotropic radiation on a horizontal plane by exciting them in a phase difference of 120°. In order to excite the notches 5 at the phase difference of 120°, wide portions (steps) 6*a* are formed on the annular microstrip line 6 to be axially symmetric at equal angular intervals of 120°. These wide portions 6*a* match the input impedance so that the phases of the current to be supplied to the respective notches 5 are shifted from each other by 120°.

The metal film 10 and the annular microstrip line 6 are formed by, e.g., plating the two surfaces of the dielectric substrate 1 with a metal and etching the formed metal plating layers. The dielectric substrate 1, the annular microstrip line 6, and the metal thin film 10 may be formed into a flexible substrate having a three-layer structure of conductor/flexible film/conductor, e.g., an aluminum/polyethylene terephthalate/aluminum, copper/polyethylene terephthalate/copper, copper/Teflon (registrated trademark)-/copper, or copper/glass-epoxy resin/copper flexible substrate. In this case, the annular microstrip line 6 and the metal thin film 10 can be formed by continuous photogravure.

Support members 3 are integrally formed with the ground plate 2 to be axially symmetric at equal angular intervals of 120°. The support members 3 are bent, and their distal ends are fixed to the metal thin film 10 by soldering or spot welding. The support members 3 serve as members to fix the dielectric substrate 1 on the ground plate 2 and as impedance matching pins to adjust the input impedance of the capacity loaded monopole antenna.

The central conductor of a feeding coaxial cable 16 for the capacity loaded monopole antenna is connected to the feeding rod 4, and outer conductor of feeding coaxial cable 16 is connected to the ground plate 2 through connectors 7.

As shown in the enlarged view of FIG. 3, the central conductors 13 of the coaxial cables 11 for feeding power to the notch antenna are insulated from the metal film 10 and connected to one end of the annular microstrip line 6 through the dielectric substrate 1. Outer conductors 14 of the feeding coaxial cables 11 are fixed to the support members 3 by clamp 15, soldering or spot welding. Thus, fixing of the coaxial cables 11 to the antenna and connection of the outer conductors 14 to the ground plate 2 are achieved simultaneously.

Referring to FIGS. 1(*a*) to 3, the feeding rod 4, the metal film 10, the support members (impedance matching pins) 3, and the ground plate 2 constitute the capacity loaded monopole antenna having matching pins, and the notches 5 and the annular microstrip line 6 constitute the notch antenna. These two antennas constitute a diversity antenna. For example, power is supplied to both antennas through both coaxial cables 11 and 16 during transmission, and an output from an antenna in a better condition is used or outputs from the both antennas are combined during reception.

The current supplied from the feeding rod 4 flows toward the support members 3 serving as the impedance matching pins. Hence, the current flowing through the metal film 10 is concentrated on the lines connecting the feeding rod 4 and the support members 3, and thus has only radial components. Therefore, even if the notches 5 are formed at positions shown in FIGS. 1(*a*) and 2, they do not adversely affect the operation of the capacity loaded monopole antenna.

The capacity loaded monopole antenna is an antenna which is sensitive to the electric field, and the notches 5 form a notch antenna which senses the magnetic field. Therefore, with the above arrangement, an antenna sensing the electric field and an antenna sensing the magnetic field are arranged at spatially the same position, and power density receiving can be performed by a flat type antenna.

Since the notches 5 have fan shapes, a bandwidth of a frequency band necessary for the notch antenna is obtained. When the size of each notch 5 is increased, the electric volume of the capacity loaded monopole antenna is decreased, and the resonant frequency is increased.

In the arrangement of FIGS. 1(*a*) to 3, the three notches are arranged to be shifted from each other by 120° and are excited at phases shifted from each other by 120°. Thus, non-directional isotropic radiation on a horizontal plane is achieved. Since the three notches suffice, the area occupied by the notch antenna is smaller than that of a conventional notch antenna, easily achieving antenna size reduction. Furthermore, power density receiving can be performed by the flat type antenna. As a result, the antenna of this embodiment is suitable for mobile communication.

Second Embodiment

The second embodiment of the present invention will be described with reference to FIGS. 4(*a*) and 4(*b*).

Figure 4A:
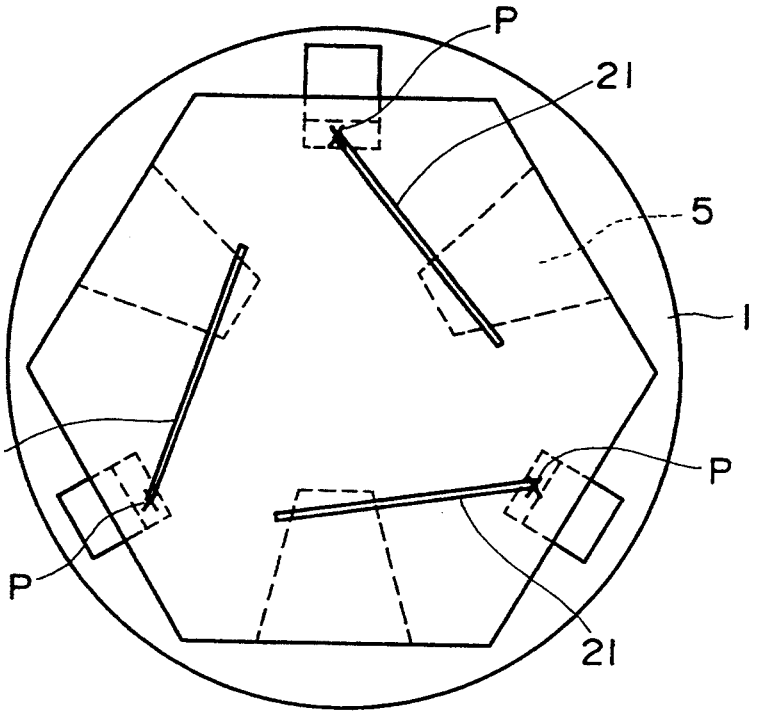
FIGS. 4(*a*) and 4(*b*) are views showing an antenna according to the second embodiment of the present invention.
Figure 4B:
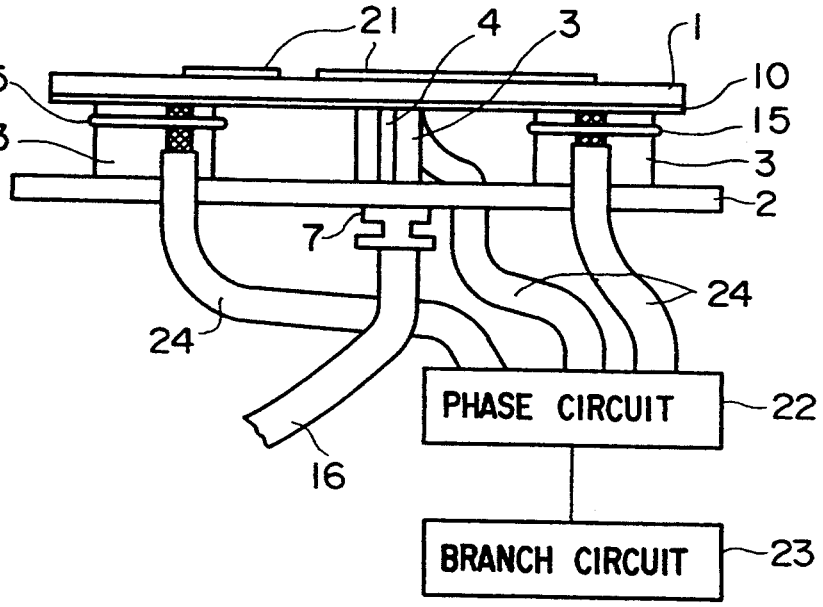

FIG. 4(*a*) is a plan view of an antenna according to this embodiment, and FIG. 4(*b*) is a side view of the same. This embodiment shows a modification of the notch antenna of the first embodiment, and feeding circuits are provided respectively to notches 5. Referring to FIGS. 4(*a*) and 4(*b*), the same portions as in FIGS. 1(*a*) to 3 are denoted by the same reference numerals, and a detailed description thereof will be omitted.

In this embodiment, as shown in FIG. 4(*a*), linear feeding lines 21 are arranged in units of the notches 5, in place of the annular microstrip line 6 shown in FIGS. 1(*a*) and 1(*b*). The respective linear feeding lines 21 extend across the corresponding notches 5 above support members 3. One end P of each linear feeding line 21 is connected to a phase circuit 22 through a corresponding coaxial cable 24, and the phase circuit 22 is connected to a branch circuit 23, as shown in FIG. 4(*b*). An output from a transmitter (not shown) is branched into three signals by the branch circuit 23 and supplied to the phase circuit 22. The phase circuit 22 phase-shifts each signal by 120°, and supplies the respective signals to the corresponding linear feeding lines 21 at phases of, e.g., 0°, 120°, and 240° to excite the corresponding notches 5.

In the arrangement of FIGS. 4(*a*) and 4(*b*) as well, the non-directional isotropic radiation on the horizontal plane is achieved, the area occupied by the notch antenna can be set smaller than that of the conventional notch antenna to easily achieve size reduction of the antenna, and power density receiving is enabled. As a result, the antenna of this embodiment is suitable for mobile communication.

Third Embodiment

Figure 5:
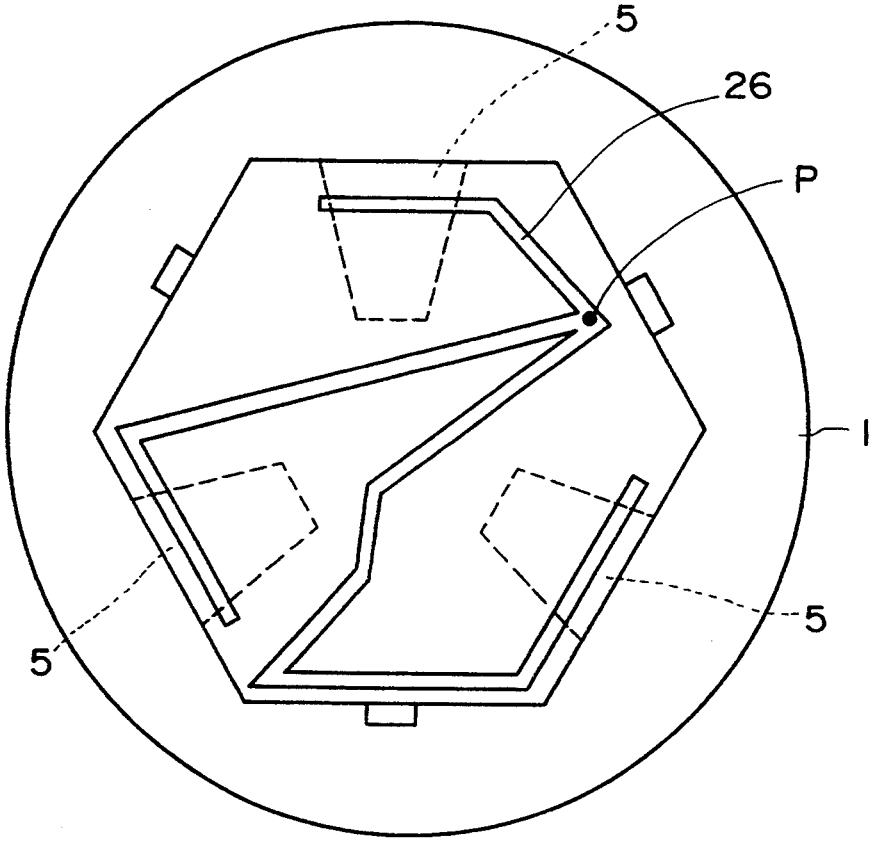
FIG. 5 is a plan view showing an antenna according to the third embodiment of the present invention.

The third embodiment of the present invention will be described with reference to FIG. 5. FIG. 5 is a plan view of an antenna according to the third embodiment of the present invention. Referring to FIG. 5, the same portions as in FIGS. 1(*a*) to 3 are denoted by the same reference numerals, and a detailed description thereof will be omitted.

In this embodiment, as shown in FIG. 5, a radial feeding line 26 is arranged on one surface of a dielectric substrate 1, in place of the annular microstrip line 6 shown in FIGS. 1(*a*) and 1(*b*); and the distal end portions of the feeding line 26 form stubs, The phases of excitation of respective notches are set to 0°, 120°, and 240° by adjusting the lengths of the radial portions of the feeding line 26.

The feeding line 26 is connected to a feeding coaxial cable at a feeding point P by using the structure shown in FIG. 3.

In the arrangement of FIG. 5 as well, the non-directionality on the horizontal plane is achieved, size reduction of the antenna is easily achieved, and power density receiving is enabled. As a result, the antenna of this embodiment is suitable for mobile communication.

Figure 7A:
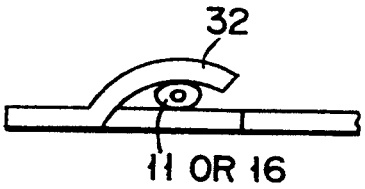
FIGS. 7(*a*) and 7(*b*) are views showing arrangements of a cable clamp.
Figure 7B:
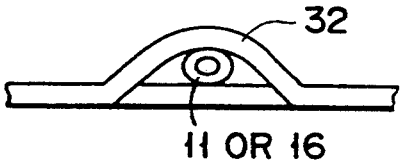
Figure 6:
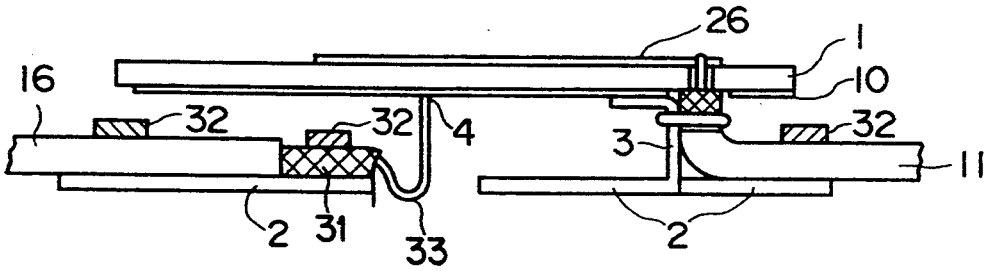
FIG. 6 is a partly sectional view showing a modification of the antenna shown in FIGS. 1(*a*) and 1(*b*)

As shown in FIG. 1(*b*), the feeding rod 4 and the coaxial cable 16 are connected to each other through the connector 7. However, as shown in FIG. 6, an outer conductor 31 of a coaxial cable 16 may be directly fixed to a ground plate 2 through clamps 32 or the like, and an inner conductor 33 may be derived from the coaxial cable 16 and connected to a feeding rod. For example, a cable clamp 32 can be integrally formed with the ground plate 2 by e.g., pressing, as shown in FIGS. 7(*a*) and 7(*b*). When the outer conductor of the coaxial cable is fixed by the clamps 32, fixing of the coaxial cable 16 and connection of the outer conductor with the base plate 2 can be performed simultaneously. The central conductor of the coaxial cable 16 may be derived, as shown in FIG. 6, and used as the feeding rod.

Fourth Embodiment

In each of the embodiments described above, the capacity loaded monopole antenna and the notch antenna constituting the diversity antenna have a single resonant frequency (resonant point). Therefore, the diversity antennae described above are not suitable for signal transmission/reception in a plurality of frequency bands, as has been described in Description of the Related Art. Hence, an embodiment of a wide-band diversity antenna having a plurality of resonant frequencies will be described.

Figure 8:
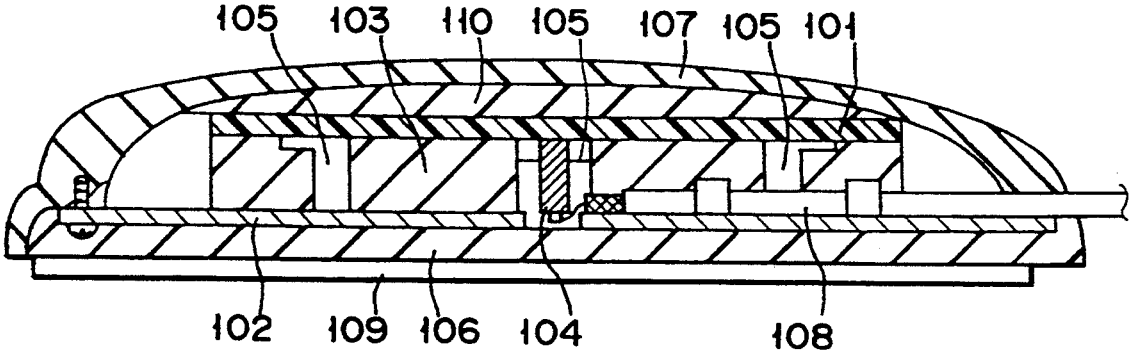
FIG. 8 is a sectional view of a flat type diversity antenna according to the fourth embodiment of the present invention.

FIG. 8 shows the sectional structure of a flat type diversity antenna according to the fourth embodiment of the present invention. This flat type antenna is roughly constituted by a dielectric substrate 101, a metal ground plate 102 arranged to be parallel to the dielectric substrate 101, a metal feeding rod 104, and support members (input-impedance matching pins) 105.

The ground plate 102 is fixed to a bottom 106 by bonding or screwing. A protection plate 103 having a predetermined thickness is sandwiched between the dielectric substrate 101 and the ground plate 102. The upper and lower surfaces of the protection plate 103 are fixed to the dielectric substrate 101 and the ground plate 102, respectively, by a viscoelastic adhesive. A press plate 110 is disposed on the dielectric substrate 101, and a cover 107 supports the press plate 110. The cover 107 has a dome-like shape so that droplets will not be accumulated on it. The bottom 106 is fixed to a movable vehicle or the like through a double-coated tape 109.

Figure 9A:
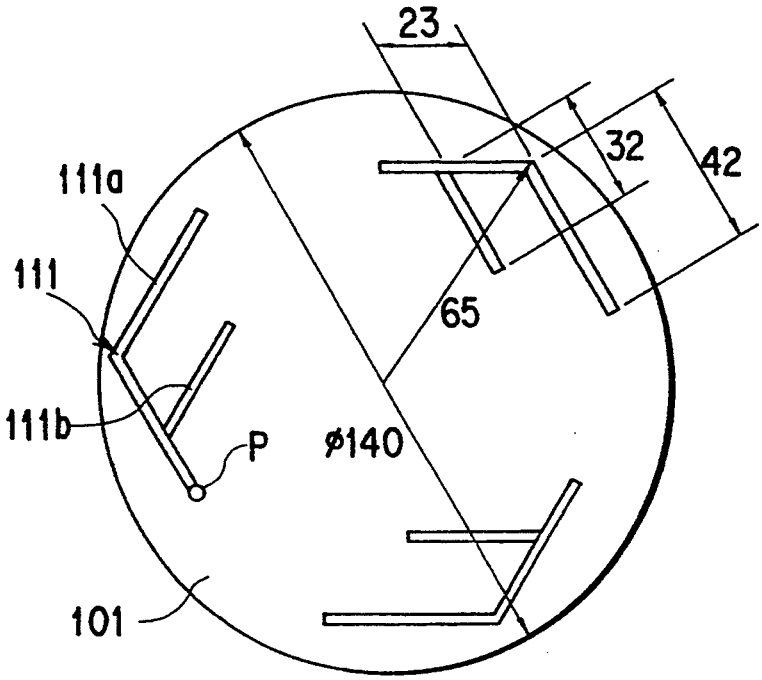
FIG. 9(*a*) is a plan view of a dielectric substrate, FIG. 9(*b*) is a side view of the same, and FIG. 9(*c*) is a bottom view of the same.
Figure 9B:
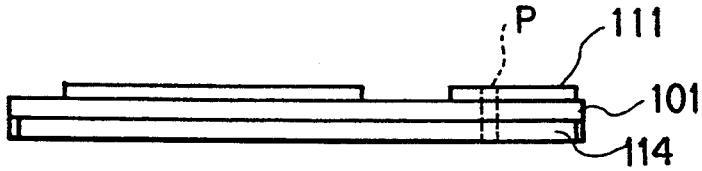
Figure 9C:
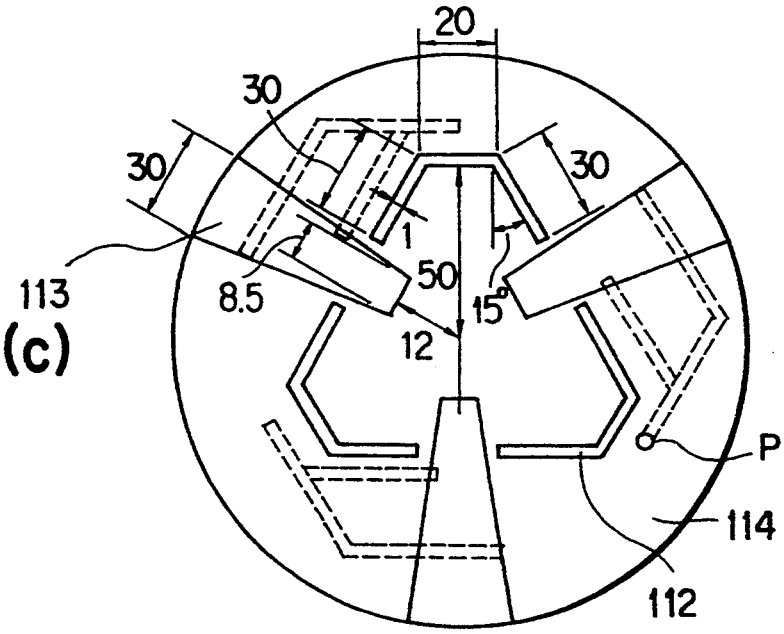

FIGS. 9(*a*) to 9(*c*) show the upper, side, and lower surfaces of the dielectric substrate 101, respectively. As shown in FIGS. 9(*a*) to 9(*c*), feeding lines 111 for feeding power to the notch antenna are formed on the upper surface of the dielectric substrate 101 to be axially symmetric at equal angular intervals of 120°. Each feeding line 111 has an ordinary feeding line 111*a* and a branch line 111*b* for resonating the notch antenna at a plurality of frequencies (resonant points).

A metal thin plate 114 made of aluminum, copper, or the like is formed on the lower surface of the dielectric substrate 101. Notches 113 are formed in the metal thin plate 114 to be axially symmetric at equal angular intervals of 120° so as to overlap the feeding lines 111. Slits 112 are formed between the notches 113 to be axially symmetric at equal angular intervals of 120°. The slits 112 are formed not to contact the notches 113 and not to overlap the feeding lines 111.

The upper end of the feeding rod 104 (FIG. 8) is fixed to the central portion of the metal thin plate 114 (FIGS. 9(*b*) and 9(*c*)) by soldering or welding.

The support members 105 (FIG. 8) are integrally formed with the ground plate 102 by pressing, and their distal ends are fixed to the metal thin plate 114 (FIGS. 9(*b*) and 9(*c*)). The support members 105 (FIG. 8) serve to match the input impedance of the capacity loaded monopole antenna and to fix the dielectric substrate 101 to the ground plate 102.

Figure 10A:
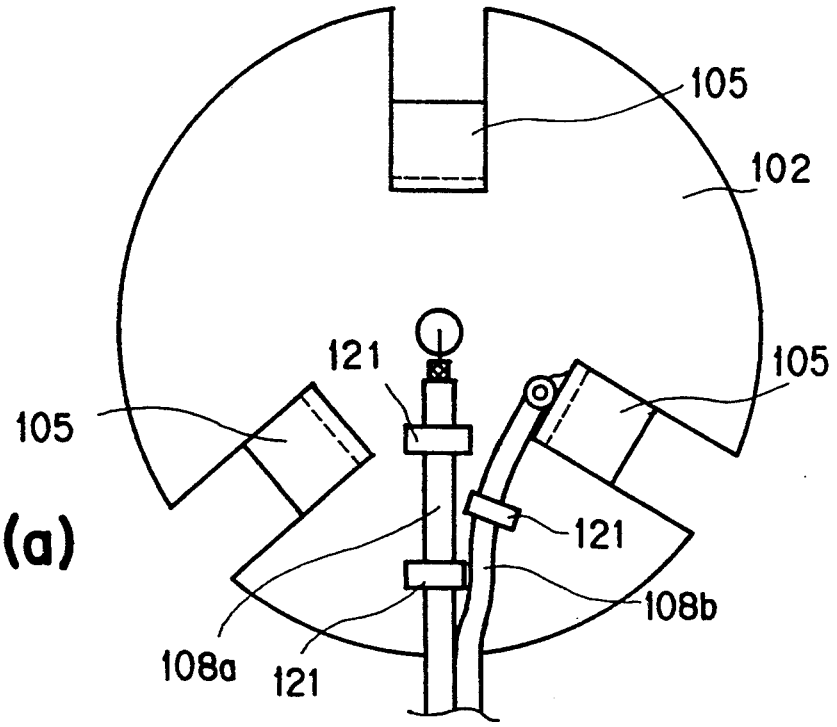
FIG. 10(*a*) is a plan view of a base plate, and FIG. 10(*b*) is an enlarged sectional view of a connecting portion of a feeding cable and a feeding line.
Figure 10B:
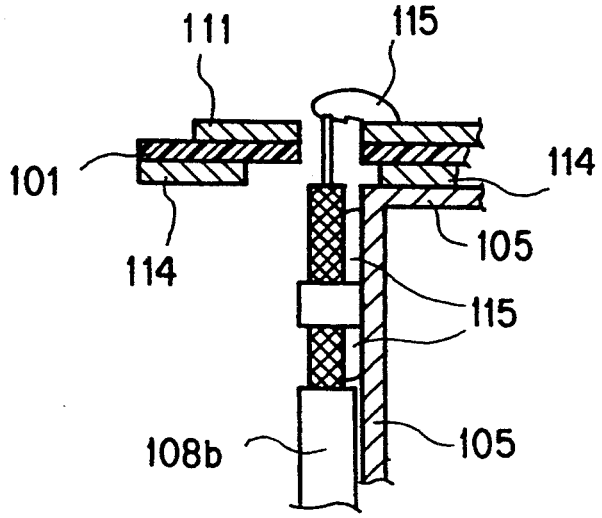

A coaxial cable 108*a* shown in FIG. 10(*a*) feeds power to the capacity loaded monopole antenna. The coaxial cable 108*a* is fixed by clamps 121 integrally formed with the ground plate 102. The central conductor of the coaxial cable 108*a* is connected to the feeding rod 104 (FIG. 8) by soldering or welding. The outer conductor of the coaxial cable 108*a* (FIG. 10*a*) is fixed to the ground plate 102 by soldering or the like. A coaxial cable 108*b* feeds power to the notch antenna. As shown in FIG. 10(*b*), the coaxial cable 108*b* is fixed to either one of the support members 105. The central conductor of the coaxial cable 108*b* extends through the dielectric substrate 101 to be connected to one point (point P in FIGS. 9(*a*) to 9(*c*)) of the feeding lines 111 through a solder 115 or the like. The outer conductor of the coaxial cable 108*b* is fixed to the corresponding support member 105 through a solder 115 or the like.

Figure 11A:
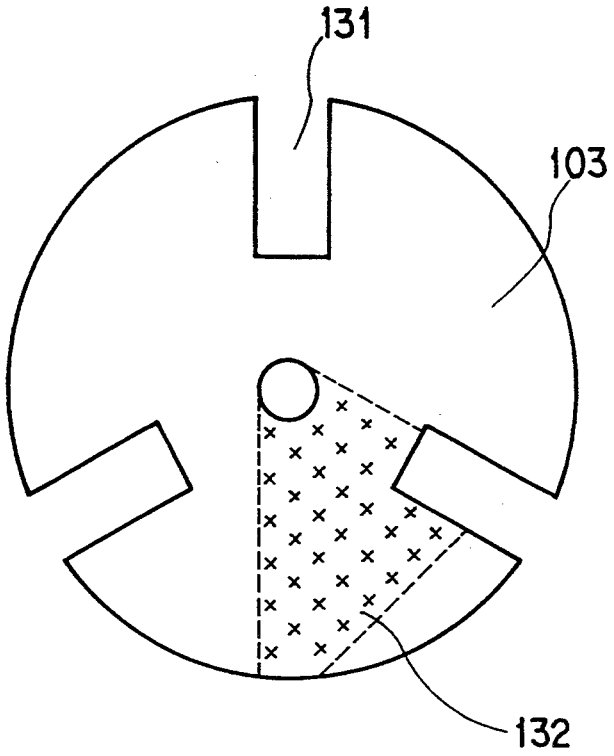
FIG. 11(*a*) is a plan view of a protection plate, and FIG. 11(*b*) is a side view of the same.
Figure 11B:
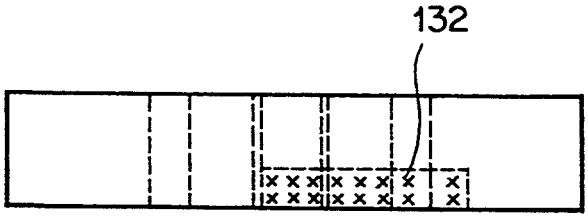

The protection plate 103 (FIG. 8) is made of a polypropylene foam having an expansion ratio of 45, and protects the dielectric substrate 101 and the base plate 102. As shown in FIGS. 11(*a*) and 11(*b*), the protection plate 103 has notches 131 for receiving the support members 105 (FIGS. 10(*a*) and 10(*b*)), and a cable escape portion 132 for escaping the coaxial cables 108*a* and 108*b* therethrough. Considering thermal expansion, the upper and lower surfaces of the protection plate 103 are bonded to the lower surface of the dielectric substrate 101 and the upper surface of the ground plate 102, respectively, through an adhesive having elasticity and viscosity.

Figure 12A:
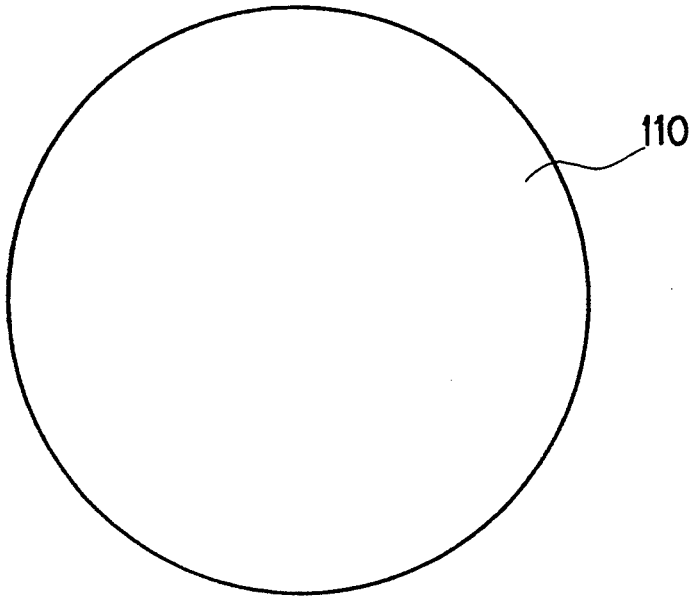
FIG. 12(*a*) is a plan view of a press plate, and FIG. 12(*b*) is and end view of the same.
Figure 12B:
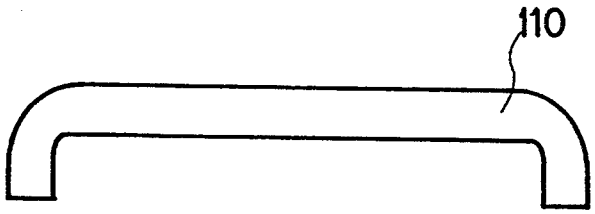

The press plate 110 is made of polypropylene foam or open-cell foam having an expansion ratio of 45, and has a shape as shown in, e.g., FIGS. 12(*a*) and 12(*b*).

In the diversity antenna having the structure described above, the ground plate 102, the feeding rod 104, the support members 105, the slits 112, and the metal thin plate 114 constitute a capacity loaded monopole antenna sensing the electric field and having a plurality of resonant frequencies. Power is supplied to the capacity loaded monopole antenna through the coaxial cable 108*a* and the feeding rod 104. The notches 113 and the feeding lines 111 constitute a notch antenna sensing the magnetic field and having a plurality of resonant frequencies. Power is supplied from the coaxial cable 108*b* to the feeding lines 111 through one point. The diversity antenna having the above structure operates in accordance with power density receiving in the same manner as in the ordinary diversity antenna.

The capacity loaded monopole antenna described above has two resonant frequencies because of the operation of the slits 112. A secondary resonant point formed by the slits 112 can be adjusted independently of the pre-existing primary resonant point by changing the lengths, widths, distances from the center, shapes, and the like of the slits 112.

The notch antenna has two resonant frequencies because of the operation of the branch lines 111*b*. A secondary resonant point formed by the branch lines 111*b* can be adjusted by changing the lengths, widths, positions, and shapes of the branch lines 111*b*.

Figure 13A:
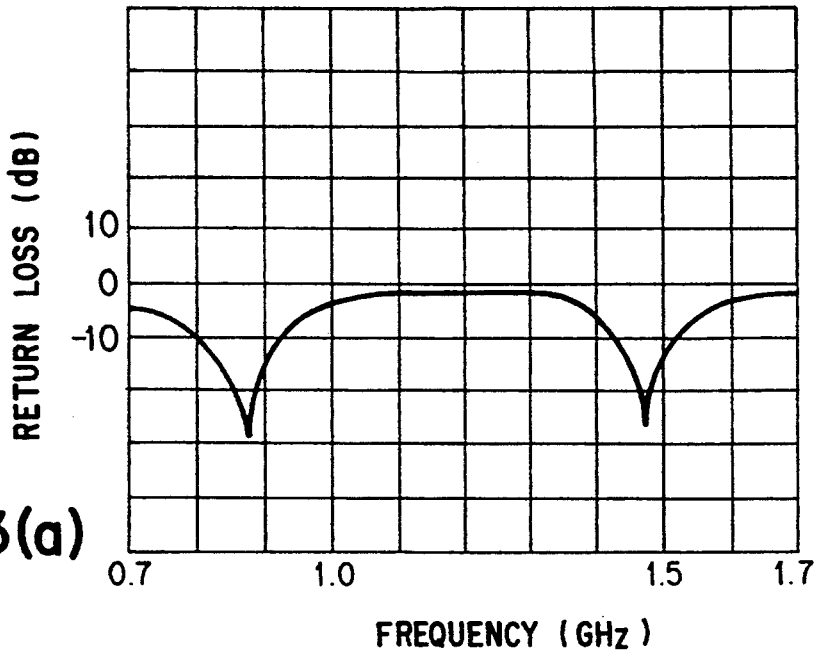
FIG. 13(*a*) is a graph showing the characteristics of a capacity loaded monopole antenna having the structure shown in FIGS. 8 to 12(*b*), and FIG. 13(*b*) is a graph showing the characteristics of a notch antenna having the structure shown in FIGS. 8 to 12(*b*)
Figure 13B:
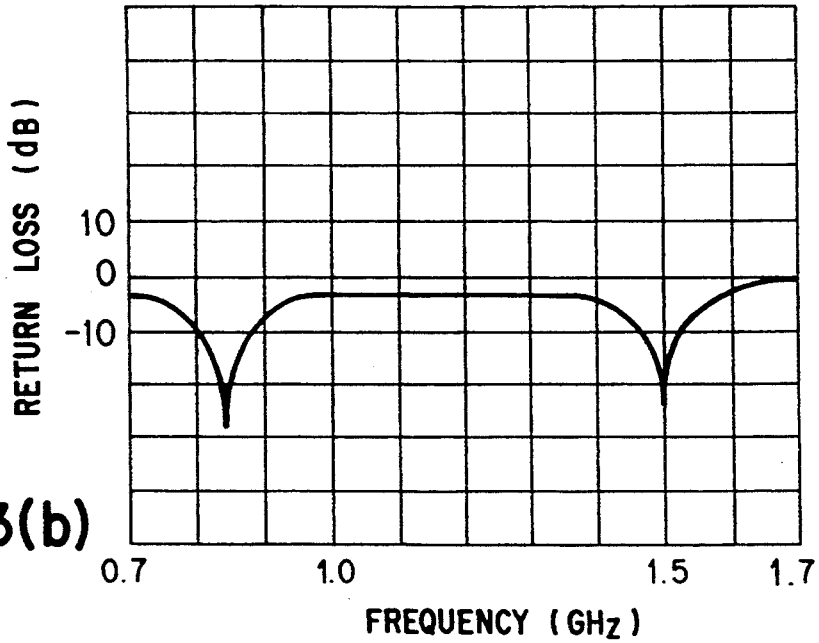

FIG. 13(*a*) shows an example of the frequency characteristics (relationship between the frequency and the return loss) of the capacity loaded monopole antenna (transmission/reception antenna) having the structure as described above. FIG. 13(*b*) shows an example of the frequency characteristics of the notch antenna (reception antenna) having the structure as described above. The axes of abscissa of FIGS. 13(*a*) and 13(*b*) represent the frequency, and the axes of ordinate represent the return loss (one scale pitch indicates 10 dB). The characteristics shown in FIGS. 13(*a*) and 13(*b*) are obtained when the sizes (mm) of the respective portions of the diversity antenna are set as shown in FIGS. 9(*a*) to 9(*c*).

Figure 14:
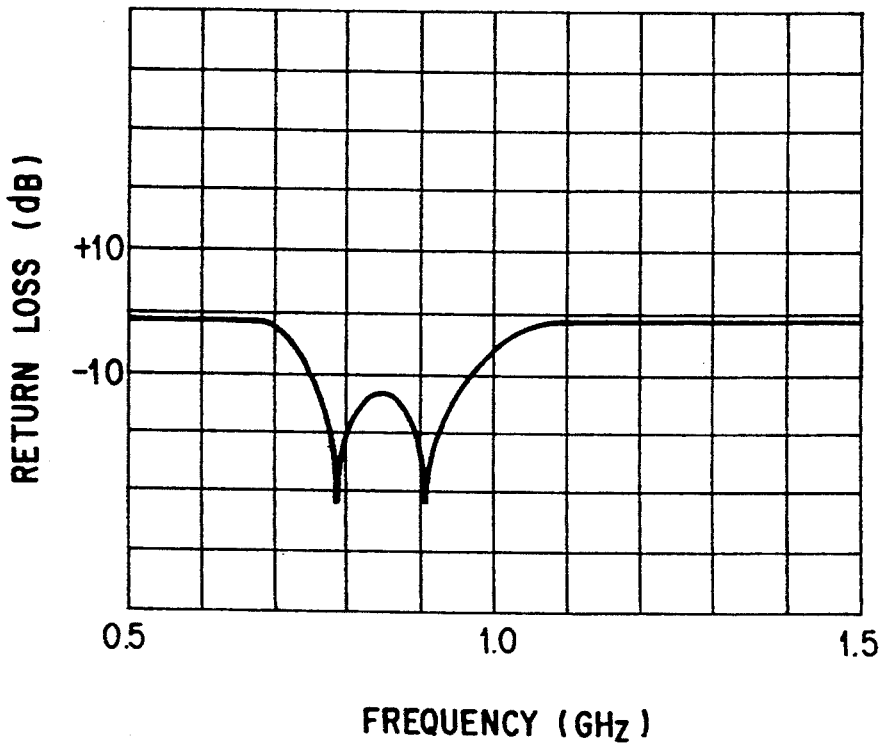
FIG. 14 is a graph showing the synthetic characteristics of the characteristics shown in FIGS. 13(*a*) and 13(*b*)

FIG. 14 shows an example of the characteristics obtained by synthesizing the characteristics shown in FIGS. 13(*a*) and 13(*b*), that is, the characteristics of the flat type diversity antenna of this embodiment.

As is understood from FIGS. 13(*a*), 13(*b*), and 14, when the branch lines 111*b* and the slits 112 are formed, a plurality of resonant points of the diversity antenna can be formed. When the plurality of resonant frequencies are set adjacent to each other, the operation band of the antenna can be widened. The characteristics shown in FIG. 14 can cover both the 800-MHz band used by car telephones and the 1.5-GHz band.

The sizes of the respective portions of this embodiment are not limited to those shown in FIGS. 9(*a*) to 9(*c*), but can be arbitrarily selected in accordance with the target resonant frequencies. The shapes of the feeding lines 111, slits 112, and notches 113 are not limited to those described above.

Figure 15A:
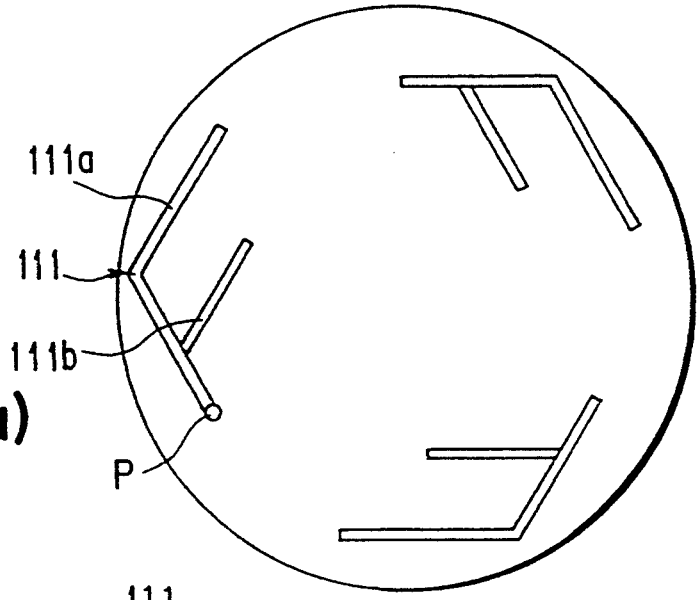
FIGS. 15(*a*) to 15(*c*) are views showing the structure of a diversity antenna having arcuated slits, in which FIG. 15(*a*) is a plan view of the dielectric substrate, FIG. 15(*b*) is a side view of the same, and FIG. 15(*c*) is a bottom view of the same.
Figure 15B:
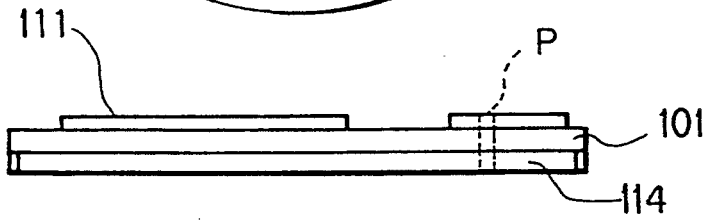
Figure 15C:
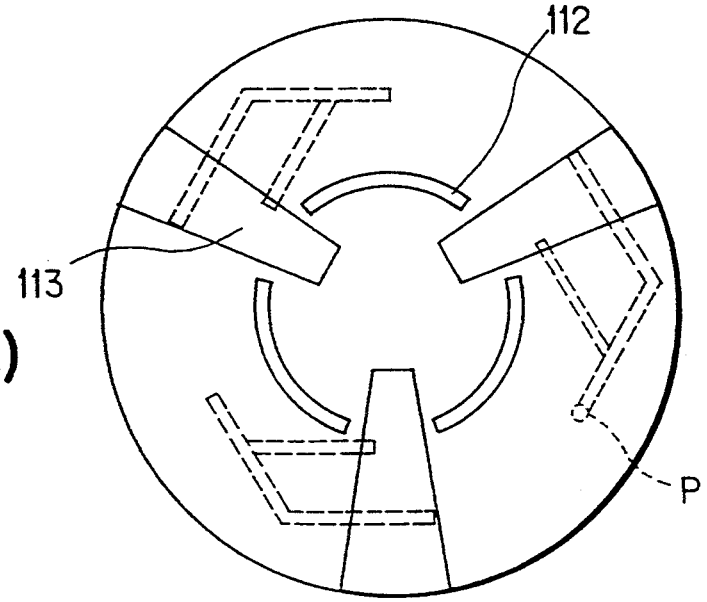
Figure 16A:
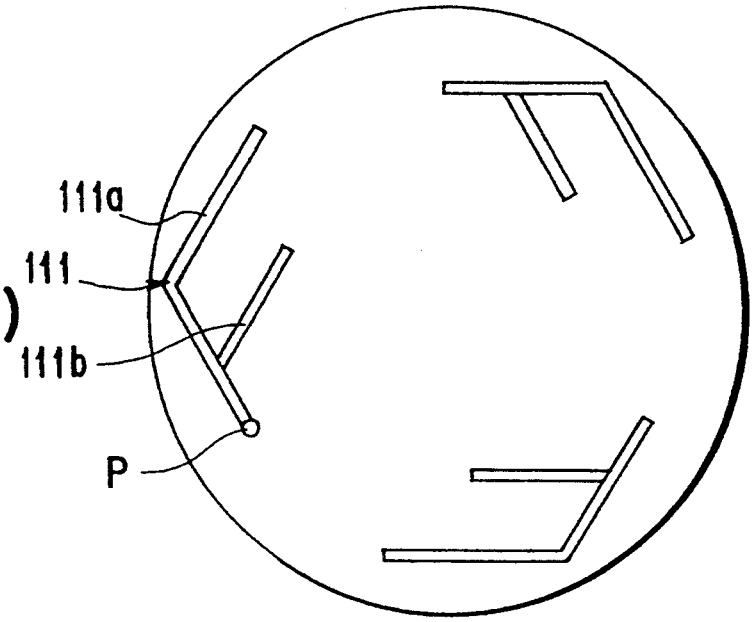
FIGS. 16(*a*) to 16(*c*) are views showing the structure of a diversity antenna having linear slits, in which FIG. 16(*a*) is a plan view of the dielectric substrate, FIG. 16(*b*) is a side view of the same, and FIG. 16(*c*) is a bottom view of the same.
Figure 16B:
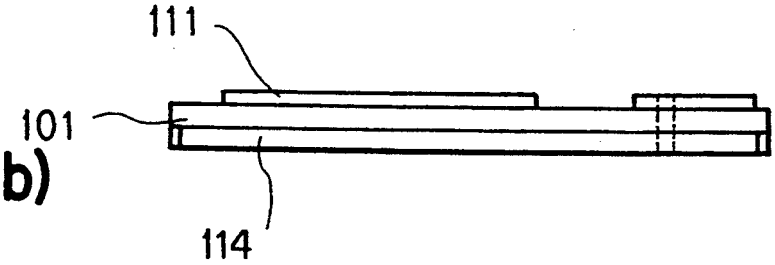
Figure 16C:
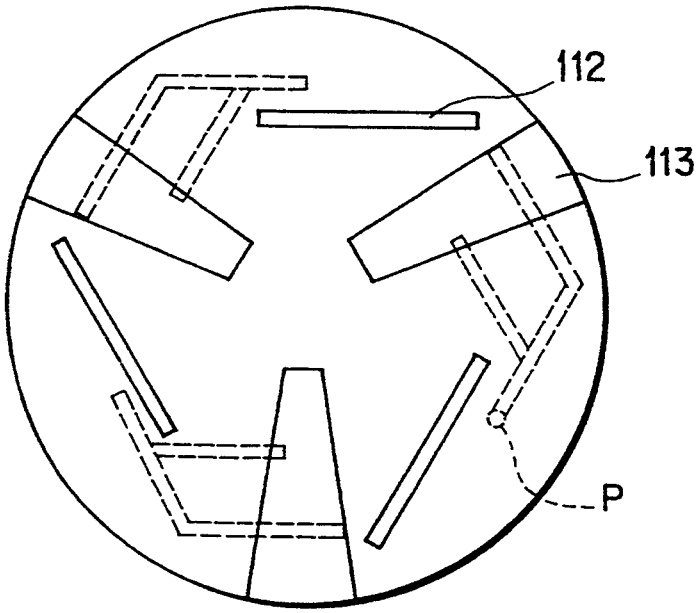

For example, FIGS. 15(*a*) to 15(*c*) show an arrangement in which slits 112 have an arcuate shape, and FIGS. 16(*a*) to 16(*c*) show an arrangement in which slits 112 have a linear shape.

Figure 17:
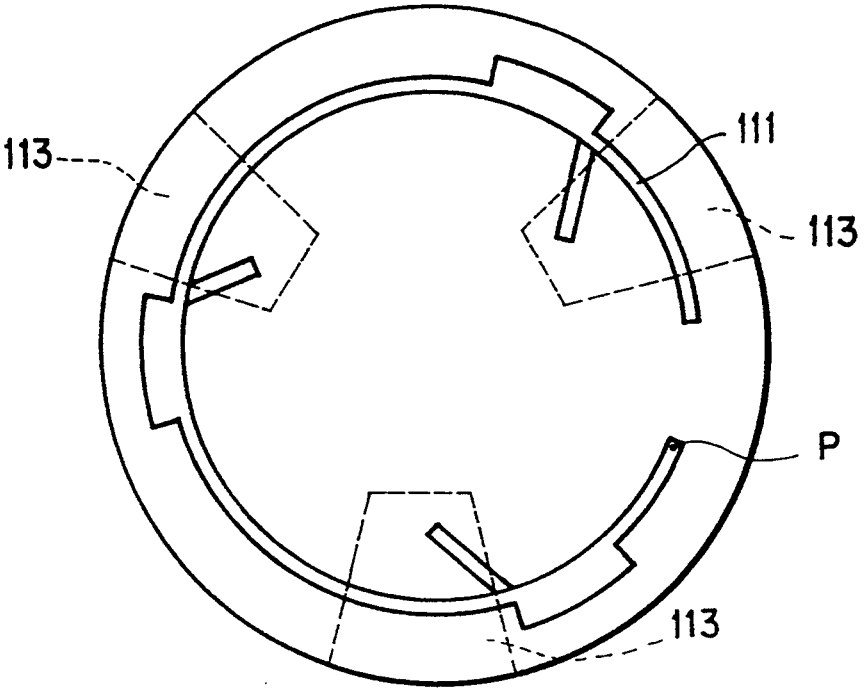
FIGS. 17 and 18 are views showing modifications of feeding lines.
Figure 18:
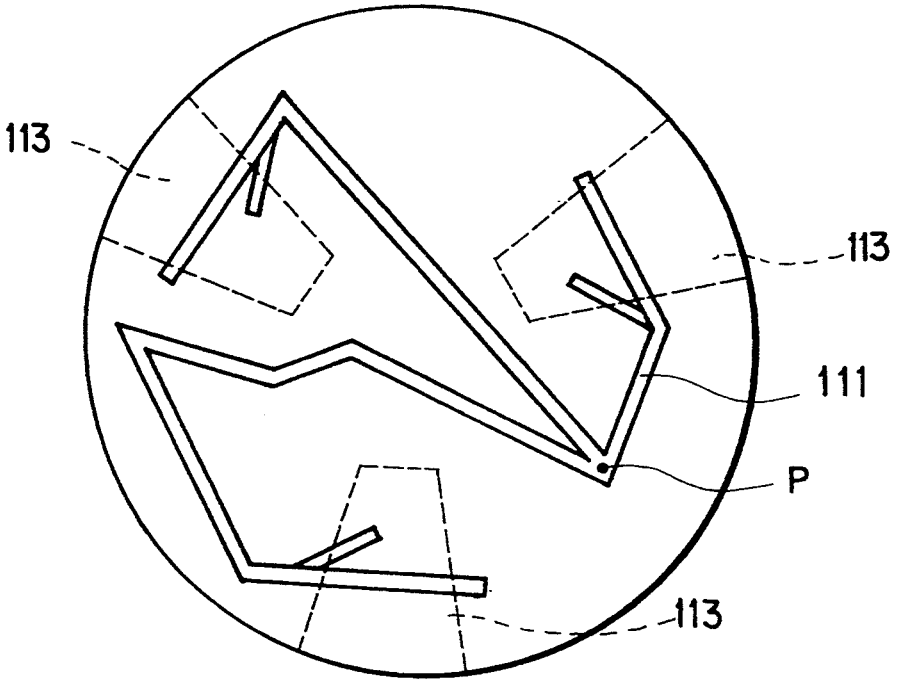

Feeding lines 111 may have the same arrangement as those of the first and second embodiments, and branch lines may be connected to them. For example, FIG. 17 shows an arrangement in which a feeding line 111 is C-shaped, and FIG. 18 shows an arrangement in which a feeding line 111 has a radial shape.

When the number of slits 112 and the number of branch lines 111*b* are increased, a diversity antenna having three or more resonant points can be obtained.

Figure 19A:
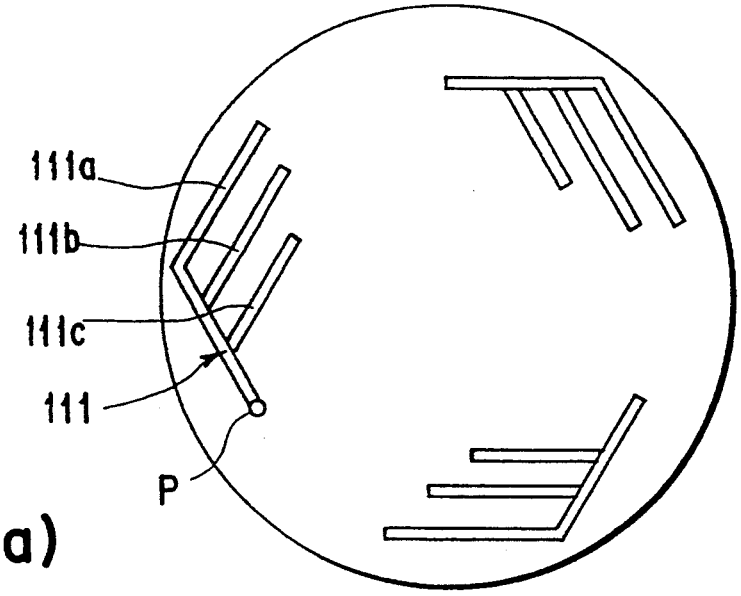
FIGS. 19(*a*) to 19(*c*) are views showing the structure of a diversity antenna having three resonant points, in which FIG. 19(*a*) is a plan view of a dielectric substrate, FIG. 19(*b*) is a side view of the same, and FIG. 19(*c*) is a bottom view of the same.
Figure 19B:
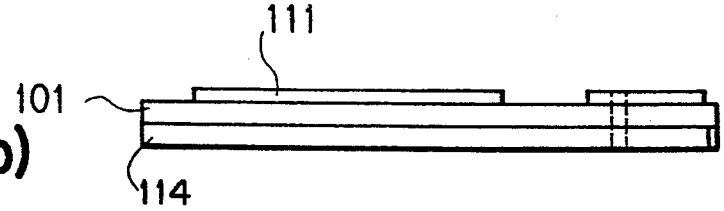
Figure 19C:
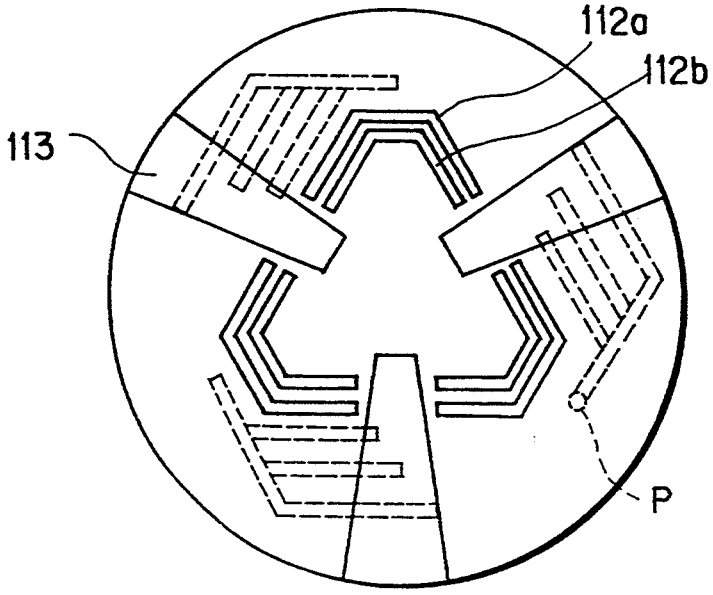
Figure 20A:
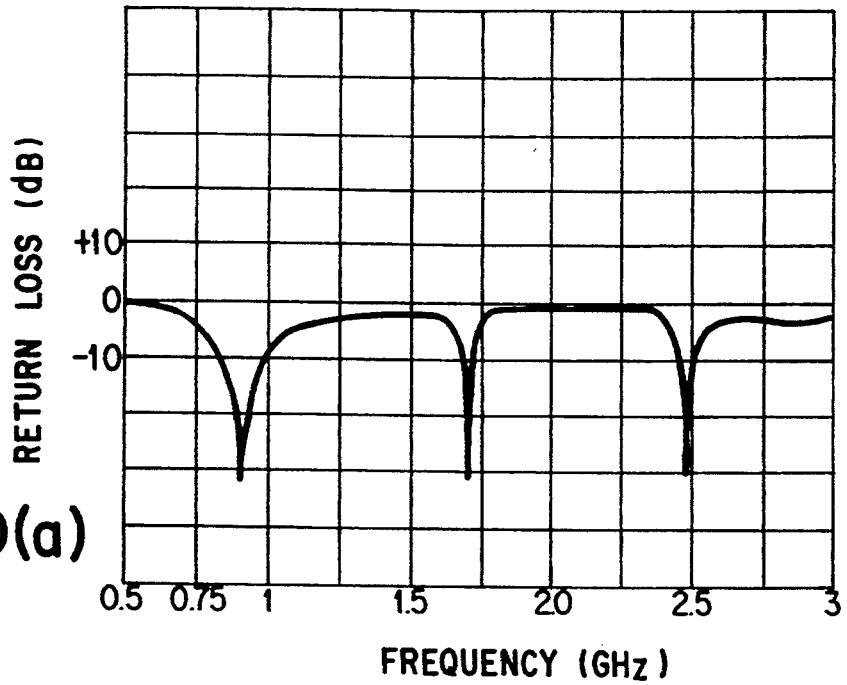
FIG. 20(*a*) is a graph showing the relationship between the frequency and the return loss of a capacity loaded monopole antenna having the structure shown in FIGS. 19(*a*) to 19(*c*), and FIG. 20(*b*) is a graph showing the relationship between the frequency and the return loss of a notch antenna having the structure shown in FIGS. 19(*a*) to 19(*c*).
Figure 20B:
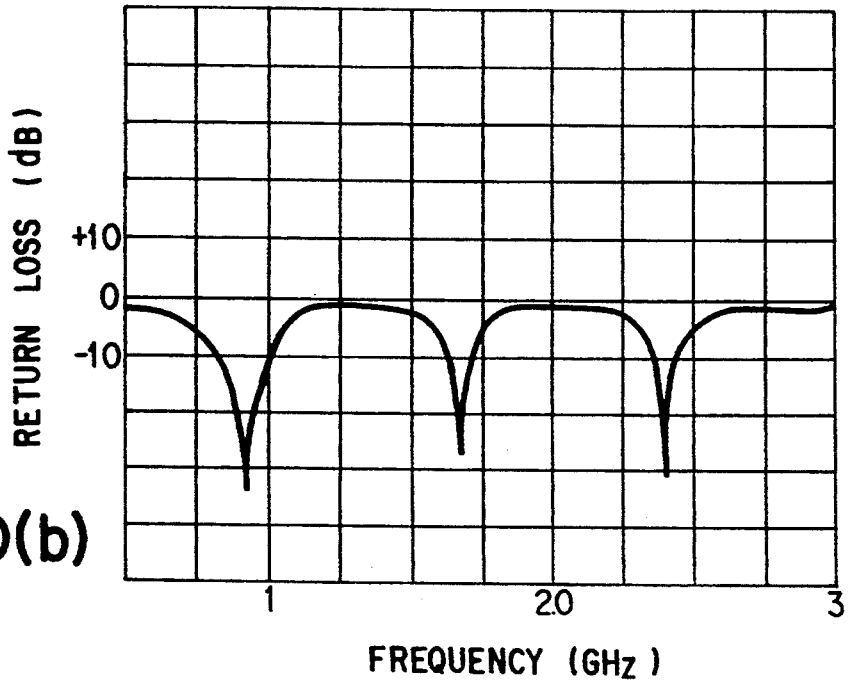

FIGS. 19(*a*) to 19(*c*) show an arrangement of a diversity antenna having two branch lines (111*b* and 111*c*) for each feeding line 111 and two slits (112*a* and 112*b*) corresponding to one slit 112. FIG. 20(*a*) shows an example of the frequency characteristics of the capacity loaded monopole antenna having the structure as shown in FIGS. 19(*a*) to 19(*c*). FIG. 20(*b*) shows an example of the frequency characteristics of the notch antenna (reception antenna) having the structure as described above. As is understood from FIGS. 20(*a*) and 20(*b*), the flat type diversity antenna shown in FIGS. 19(*a*) to 19(*c*) has three resonant points.

when the number of slits 112 and the number of branch lines 111*b* are increased, three or more resonant points can be imparted to the flat type diversity antenna.

According to the first to fourth embodiments, since each notch has a fan shape, a wide band can be obtained for the notch antenna, Since the notches are formed to be axially symmetric at equal angular intervals of 120°, the area of the notch antenna can be decreased when compared to the conventional diversity antenna in which notches are arranged to be axially symmetric at equal angular intervals of 90°. Thus, the electric volume of the capacity loaded monopole antenna can be effectively determined, thus decreasing the size of the diversity antenna.

When the feeding circuit of the notch antenna is set to have a C shape with steps for phase adjustment, power feeding to the notch antenna can be performed with a simple structure.

According to the fourth embodiment, a single antenna can perform signal transmission/reception in a plurality of frequency bands, and can be used as a diversity antenna for improving the communication level. Accordingly, one antenna suffices for the plurality of frequency bands. In addition, since this diversity antenna is a flat type antenna, it can be embedded even in a small space of a movable object without forming a projection or the like. During embedding, the base plate can be integrally formed with the chassis of the car in order to decrease the entire size.

When the press plate is arranged between the dielectric substrate and the cover, and the protection plate is arranged between the dielectric substrate and the base plate, the durability against external factors, e.g., vibration, can be improved. When a flexible substrate is used as the dielectric substrate, the structure of the antenna is simplified.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A flat type diversity antenna comprising:

a conductive plate;

a dielectric substrate arranged to be substantially parallel to said conductive plate;

a conductive layer formed on a surface of said dielectric substrate facing said conductive plate and having notches and slits formed therein;

feeding lines, formed on a surface of said dielectric substrate not facing said conductive plate, and having branch lines for feeding power to the notches, thereby causing multi-resonance of the notches;

a feeding rod having one end connected to said conductive layer; and matching pins for short-circuiting said conductive plate and said conductive layer and for matching an input impedance.

2. An antenna according to claim 1, wherein:

each of the slits has one of a U shape, an arcuate shape, and a linear shape, and a number, width, and length of said branch lines and a number, position, and size of the slits are adjusted to satisfy a number of frequency bands to be used and a frequency bandwidth to be used.

3. An antenna according to claim 1, wherein the notches are axially symmetric at substantially equal angular intervals of 120°, the slits are axially symmetric at substantially equal angular intervals of 120° without contacting the notches, and said feeding lines are axially symmetric at substantially equal angular intervals of 120° without overlapping the slits and receive power from a feeding coaxial cable at one point.

4. An antenna according to claim 1, wherein:

an insulating protection plate is arranged between said dielectric substrate and said conductive plate, one surface of said protection plate and said conductive plate, and another surface of said protection plate and said conductive layer are bonded with each other by an adhesive having viscosity and elasticity, and said dielectric substrate is supported by a cover having a dome-shaped upper surface through a press plate.

* * * * *